US008959728B2

(12) United States Patent
Ozawa

(10) Patent No.: US 8,959,728 B2
(45) Date of Patent: Feb. 24, 2015

(54) SLIDER FOR SLIDE FASTENER

(75) Inventor: Takanori Ozawa, Toyama (JP)

(73) Assignee: YKK Corporation, Atlanta, GA (US)

( * ) Notice: Subject to any disclaimer, the term of this patent is extended or adjusted under 35 U.S.C. 154(b) by 19 days.

(21) Appl. No.: 13/824,520

(22) PCT Filed: Sep. 22, 2010

(86) PCT No.: PCT/JP2010/066439

§ 371 (c)(1),
(2), (4) Date: Mar. 18, 2013

(87) PCT Pub. No.: WO2012/039039

PCT Pub. Date: Mar. 29, 2012

(65) Prior Publication Data

US 2013/0185904 A1 Jul. 25, 2013

(51) Int. Cl.
*A44B 19/30* (2006.01)

(52) U.S. Cl.
CPC ..... *A44B 19/30* (2013.01); *A44B 19/306* (2013.01)
USPC ..... 24/421; 24/418; 24/420

(58) Field of Classification Search
CPC ..... A44B 19/30; A44B 19/306; A44B 19/308
USPC ..... 24/418–421, 423, 424
See application file for complete search history.

(56) References Cited

U.S. PATENT DOCUMENTS 2,635,314 A * 4/1953 Firing ..... 24/421
2,737,699 A * 3/1956 Erdmann ..... 24/421
2,989,792 A * 6/1961 Huelster ..... 24/421
3,010,170 A * 11/1961 Voity et al. ..... 24/421
3,038,226 A * 6/1962 Kedzierski ..... 24/421
3,262,172 A * 7/1966 Scheuerman ..... 24/421
3,287,780 A * 11/1966 Cooperberg ..... 24/421
4,069,556 A * 1/1978 Takahashi ..... 24/421
4,074,399 A * 2/1978 Kedzierski ..... 24/425

(Continued)

FOREIGN PATENT DOCUMENTS

EP 0251316 A1 1/1988
EP 1479307 A1 11/2004

(Continued)

OTHER PUBLICATIONS

International Search Report, PCT Application No. PCT/JP2010/066439, mailed Nov. 2, 2010.

*Primary Examiner* — Robert J Sandy
*Assistant Examiner* — David Upchurch
(74) *Attorney, Agent, or Firm* — Kilpatrick Townsend & Stockton LLP

(57) ABSTRACT

A slider for slide fasteners having a slider body with the leading end of the upper and lower plates connected by a connecting bar and a y-shaped element guiding path disposed between the upper and lower plates, a pull with one end rotatably held on the upper plate, and a stopping hook disposed on the upper plate and having a hook at one end; the upper plate having an insertion groove for inserting the stopping hook, a locking part for locking the other end of the stopping hook, and a hook eyelet drilled so that the hook can be inserted; and the stopping hook is disposed so that by tilting/erecting manipulations of the pull, the hook can be inserted/withdrawn from the element guiding path through the hook eyelet; wherein the corners of the stopping hook that contact the locking part, at least during locking operation, form beveled parts.

4 Claims, 9 Drawing Sheets

(56) References Cited

U.S. PATENT DOCUMENTS

| | | | | |
|---|---|---|---|---|
| 4,139,928 | A * | 2/1979 | Aoki et al. | 24/424 |
| 4,391,022 | A * | 7/1983 | Oda | 24/421 |
| 4,719,673 | A * | 1/1988 | Kubo | 24/421 |
| 4,768,263 | A | 9/1988 | Fukuroi et al. | |
| 4,980,954 | A * | 1/1991 | Takabatake et al. | 24/421 |
| 5,442,837 | A * | 8/1995 | Morgan | 24/400 |
| 6,588,072 | B1 * | 7/2003 | Lin | 24/421 |
| 6,647,598 | B2 * | 11/2003 | Lin | 24/420 |
| 2004/0231114 | A1 | 11/2004 | Iwase et al. | |
| 2011/0197403 | A1 | 8/2011 | Keyaki et al. | |

FOREIGN PATENT DOCUMENTS

| | | | |
|---|---|---|---|
| JP | 63-145605 | A | 6/1988 |
| JP | 2004-344313 | A | 12/2004 |
| WO | 2010/070744 | A1 | 6/2010 |

* cited by examiner

Prior Art

Prior Art

SLIDER FOR SLIDE FASTENER

This application is a national stage application of PCT/JP2010/066439 which is incorporated herein by reference.

TECHNICAL FIELD

The present invention relates to a slider for slide fastener, which has an automatic stop mechanism using a locking pawl.

RELATED ART

Conventionally, as a slider used for a slide fastener, there has been known a slider having an automatic stop mechanism in which when a pull is set free from being operated after unzipping or zipping, a locking pawl assembled in the slider keeps the slider at a stop position as energized by the spring force thereof, and keeps the stop state of the slider unchanged unless otherwise the pull is operated again. This sort of slider is disclosed in International Patent Publication WO2010/070744 (Patent Document 1).

As illustrated in FIG. 9 and FIG. 10, a slider 1C disclosed in Patent Document 1 has a slider body 2 in which front ends of upper and lower wing plates 21, 22 are connected by a connection post 23, and a Y-shaped element guiding path is disposed between the upper and lower wing plates 21, 22, a pull 5 swingably held at one end thereof by the upper wing plate 21, and a locking pawl 6 arranged to the upper wing plate 21 and having a pawl portion 61 at one end thereof. The upper wing plate 21 has an insertion groove 32 into which the locking pawl 6 is inserted, caulking portions 34 which caulk and fix the other end of the locking pawl 6, and a pawl hole 37 pierced so as to allow therethrough insertion of the pawl portion 61. The locking pawl 6 is disposed so as to allow the pawl portion 61 to be inserted to, or ejected from the element guiding path through the pawl hole 37 by falling or erecting operations of the pull 5.

Patent Document 1 also proposes to arrange the caulking portions 34 in the above-mentioned slider so that the level of height of upper ends 34*a* of the caulking portions 34 are aligned in the same plane with the top surface of the upper wing plate 21, or kept lower than the top surface when the locking pawl 6 is caulked and fixed therein, for the purpose of preventing the locking pawl from being limited in travel when the slider is used, smoothening the inserting/ejecting operations of the pawl portion 61 to or from the element guiding path, and thereby stably maintaining the sliding characteristics of the slider and the automatic stop mechanism over a long term. More specifically, it is described that a recess 33 is provided with the top surface side of a portion of the upper wing plate 21 where the connection post 23 is connected while placing the insertion groove 32 in between, and the caulking portions 34 are provided so as to rise up from the bottom surface of the recess 33.

RELATED ART DOCUMENT

PATENT DOCUMENT 1: International Patent Publication No. WO2010/070744

SUMMARY OF THE INVENTION

Problems to be Solved by the Invention

According to the slider 1 described in Patent Document 1, the level of height of the upper end of the caulking portions 34, having the locking pawl 6 caulked and fixed therein, is aligned in the same plane with the top surface of the upper wing plate 21 or kept lower than the top surface, so that the pull 5 is prevented from colliding on the caulking portions 34 even if tilted down towards the front end of the slider body 2, and also the caulking portions 34 are prevented from being brought into contact with other members, and thereby the caulking portions 34 are prevented from being directly applied with external force, and from crushing as a consequence, when the slider 1 is used. Accordingly, a clearance provided when the other end of the locking pawl 6 is fixed by the caulking portions 34 may be maintained in a stable manner, and thereby producing a benefit of reducing limitation on the travel of the locking pawl when the slider is used.

However, the present inventors have found out that the slider 1 described in Patent Document 1 may sometimes fail in achieving a sufficient level of spring force for ensuring the stop position of the slider 1 biased by the locking pawl 6, and may even be likely to cause cracks in the caulking portions 34. Therefore the main object of the present invention is to provide a slider which allows the locking pawl 6 to fully express a desired level of spring force, and less likely to cause cracks in the caulking portions 34.

Means for Solving the Problem

The present inventors have made intensive studies so as to solve the above-described problems, and have found out that the locking pawl described in Patent Document 1 has an angular ridge, so that when the locking pawl is caulked by inwardly bending the left and right caulking portions, the ridge is likely to be caught by a contact surfaces with the caulking portions 34, and thereby the locking pawl 6 is less readily placed to a predetermined position. If the locking pawl 6 is held before being fully descended to the predetermined position, the locking pawl 6 cannot express an expected level of spring force and is weakened in the function of maintaining the stop position of the slider. It was also found that the caulking portions 34 are subjected to local stress in the contact surface thereof with the locking pawl 6, from which cracks tend to originate. The present inventors therefore have improved the structure in which the caulking portions 34 may be prevented from being subjected to local stress by chamfering the ridge of the caulking portions 34 to be brought into contact with the locking pawl 6.

According to one aspect of the present invention, there is provided a slider for slide fastener which includes a slider body in which upper and lower wing plates are connected to each other at the front ends thereof by a connection post, and a Y-shaped element guiding path is disposed between the upper and lower wing plates; a pull swingably held at one end thereof by the upper wing plate; and a locking pawl disposed in the upper wing plate and having a pawl portion on one end thereof, the upper wing plate including an insertion groove into which the locking pawl is inserted; a caulking portion caulking and fixing the other end of the locking pawl; and a pawl hole pierced so as to allow therethrough insertion of the pawl portion, the locking pawl being arranged so as to allow the pawl portion to be inserted to, or ejected from the element guiding path through the pawl hole by falling or erecting operations of the pull, wherein a ridge of the locking pawl, which is brought into contact with the caulking portion, is provided with a chamfer portion.

In one embodiment of the slider for slide fastener according to the present invention, the chamfer has an rounded profile and has a slip surface so as to be slidable over a contact surface with the caulking portions, and the locking pawl is adjusted in the spring force thereof by the action of caulking.

In another embodiment of the slider for slide fastener according to the present invention, the locking pawl has a hook portion which is formed by bending the other end located on the opposite side of the pawl portion, and is directed to be engaged in a front end of the insertion groove, a flat portion extending along the insertion groove is provided between the pawl portion and the hook portion, the ridge to be brought into contact with the caulking portions is located on a top surface of the flat portion, and the chamfer portion is also provided at a top surface of a bent portion which forms a boundary between the hook portion and the flat portion.

In another embodiment of the slider for slide fastener according to the present invention, the pull has a pull body, left and right arm portions extending from one end of the pull body in a parallel manner, and a connecting bar connecting end parts of the left and right arm portions, a cam portion is integrally provided at a center portion of the connecting bar and protrudes into an opening formed by the connecting bar, the left and right arm portions, and one edge of the pull body, a cover portion having a nearly U-shaped cross section is provided between the pawl portion and hook portion of the locking pawl and is disposed so as to cover the connecting bar and the cam portion from above, and a ridge of the cover portion, which is brought into contact with the cam portion or the connecting bar, is provided with a rounded chamfer portion.

Effect of the Invention

According to the slider of the present invention, the ridge of the locking pawl to be brought into contact with the caulking portion is chamfered, so that the locking pawl becomes more smoothly slidable over the contact surface with the caulking portion. Accordingly, the locking pawl becomes less likely to be caught by the caulking portion, and thereby the locking pawl becomes more readily be arranged to a predetermined position. In the case that the locking pawl is arranged to the predetermined position, the locking pawl is now possible to fully express its desired spring force, and thereby reliability of an automatic stop mechanism of the slider improves. In addition, according to the slider of the present invention, since the caulking portion is relieved from local stress on the contact surface thereof with the locking pawl, the contact surface becomes less likely to originate cracks, and thereby the caulking portion may be improved in the durability.

DESCRIPTION OF EMBODIMENTS

In the following, embodiments of the present invention are described in detailed based on Examples with reference to the drawings.

Example 1

Figure 1:
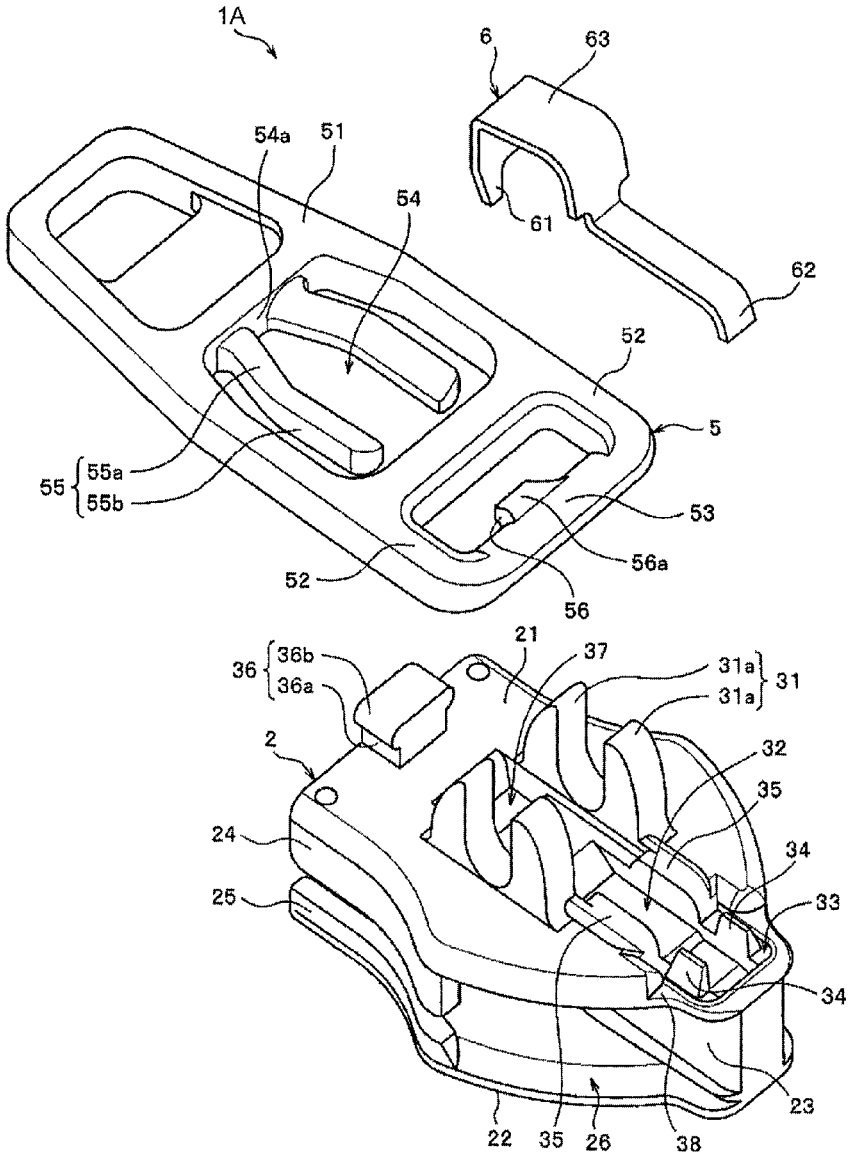
FIG. 1 is a perspective view of a slider of Example 1 of the present invention, with the constituents exploded.
Figure 2:
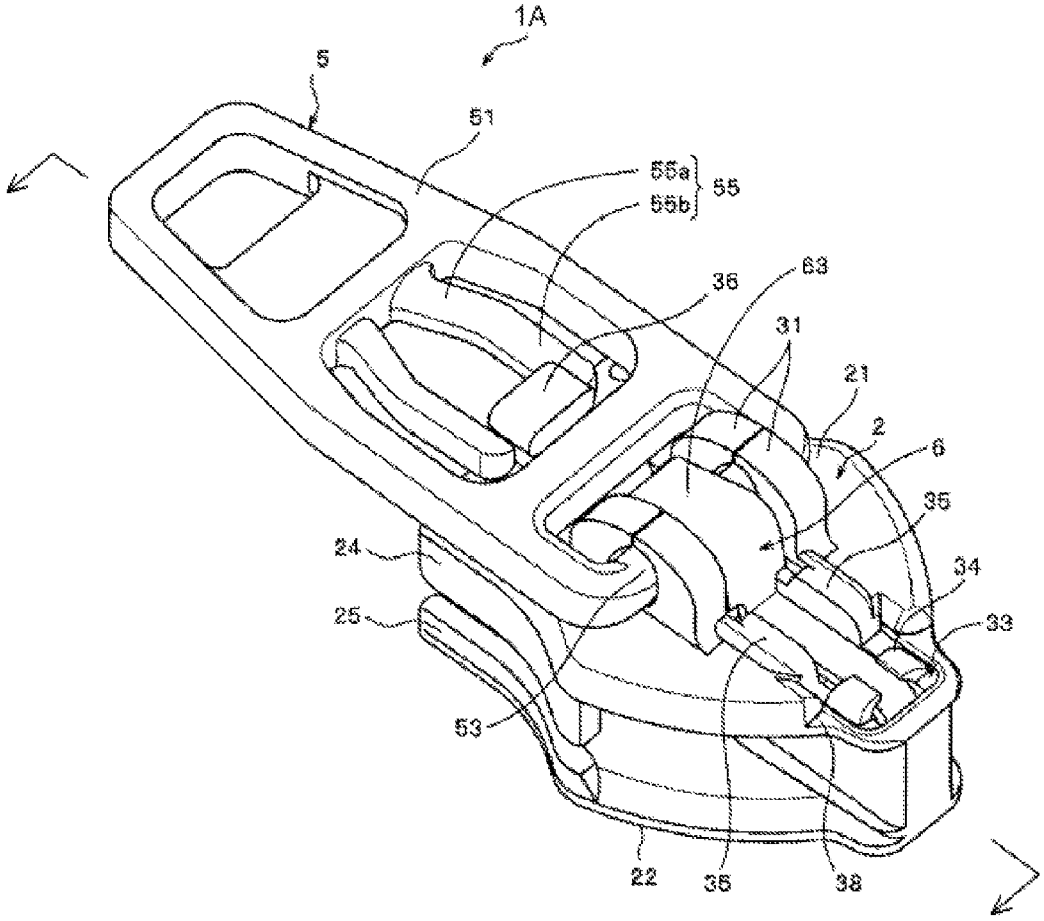
FIG. 2 is a perspective view of the slider of Example 1 of the present invention, with the constituents assembled.
Figure 3:
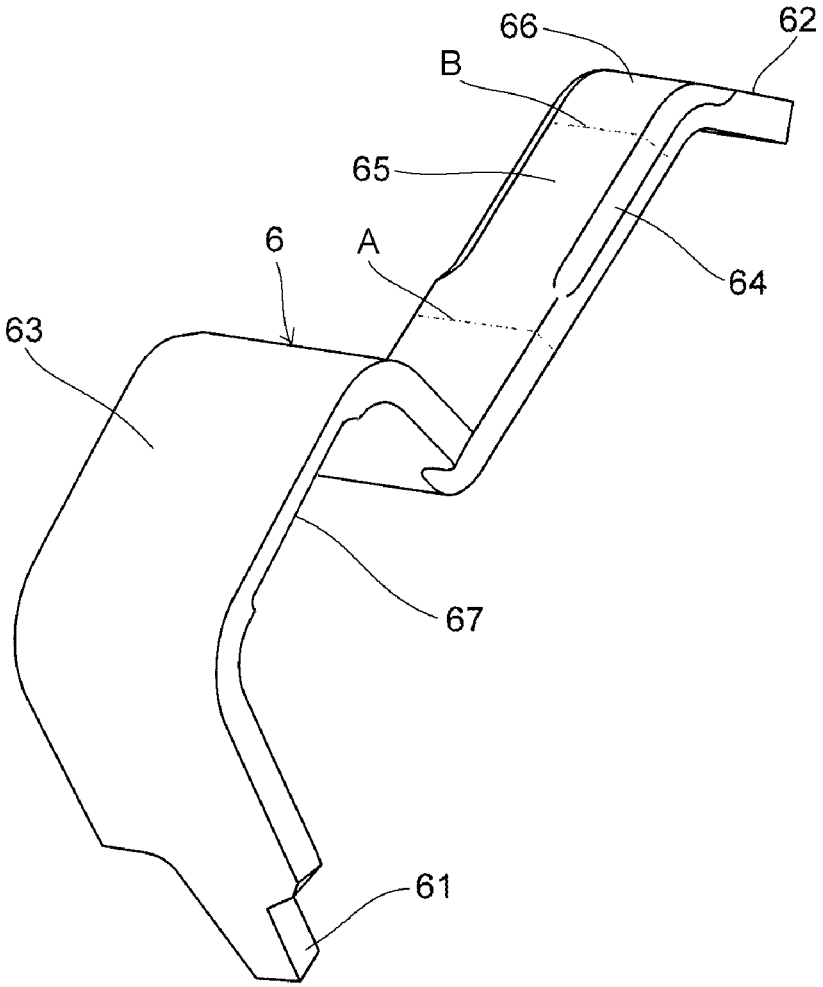
FIG. 3 is a perspective view illustrating a geometry of the locking pawl in Example 1.
Figure 5:
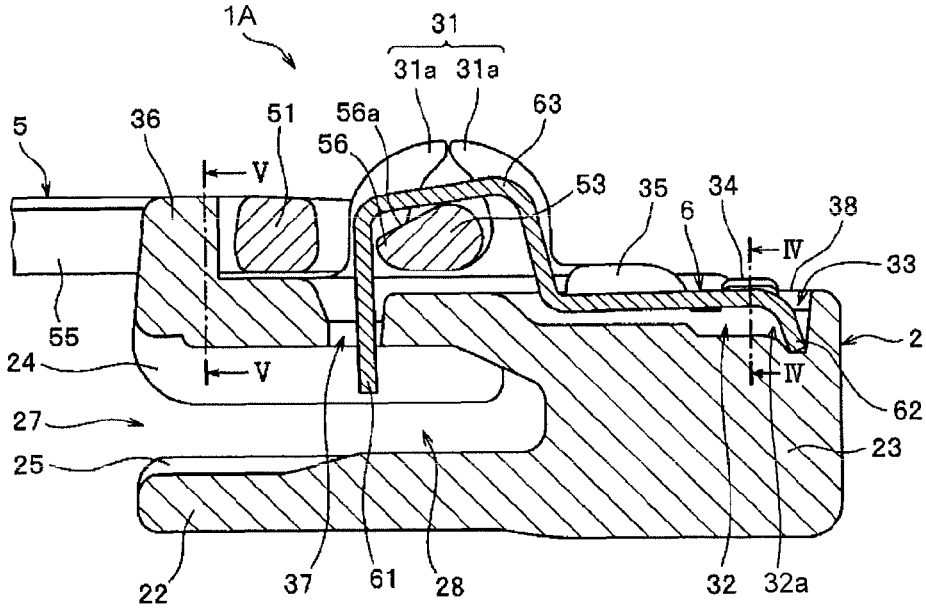
FIG. 5 is a center cross sectional view taken in parallel with the front-back direction and vertical direction in FIG. 2.

FIG. 1 is a perspective view of a slider for slide fastener 1A according to Example 1 of the present invention, with the constituents exploded, and FIG. 2 is a perspective view of the slider in an assembled state. FIG. 5 is a center cross sectional view taken along the front-back direction and vertical direction in FIG. 2. FIG. 3 is a perspective view illustrating a geometry of the locking pawl 6 in Example 1.

In the slider 1A of the present invention, the direction towards which the slider slides to engage element arrays is defined as front, and the direction towards which the slider slides to separate the element arrays is defined as rear. The direction orthogonal to the upper and lower wing plates is defined as the vertical direction, and the direction parallel to the upper and lower wing plates, and orthogonal to the direction of sliding of the slider is defined as the transverse direction.

The slider for slide fastener 1A of Example 1 has, as seen in FIG. 1, FIG. 2 and FIG. 5, a slider body 2, a pull 5 swingably held at one end thereof by the slider body 2, and a locking pawl 6 disposed in the slider body 2. In the slider 1A of Example 1, the slider body 2 and the pull 5 are manufactured by die casting using a metal material such as copper alloy, aluminum alloy or zinc alloy. The locking pawl 6 is manufactured by using a metal material such as stainless steel or copper alloy, by press forming.

The slider body 2 has, as seen in FIG. 1, FIG. 2 and FIG. 5, an upper wing plate 21, a lower wing plate 22, and a connection post 23 which connects the upper and lower wing plates 21, 22 at front end side thereof. Upper flanges 24 are formed on the left and right edges of the upper wing plate 21 toward the lower wing plate 22. Lower flanges 25 are formed on the left and right edges of the lower wing plate 22 toward the upper wing plate 21.

Furthermore, the slider body 2 has, as seen in FIG. 1, FIG. 2 and FIG. 5, shoulder holes 26 which is disposed at the front end of the slider body 2 and is located on the left and right of the connection post 23, and a rear hole 27 which is disposed at the rear end of the slider body 2. A Y-shaped element guiding path 28 is defined between the upper and lower wing plates 21, 22 and connects the left and right shoulder holes 26 and the rear hole 27.

The upper wing plate 21 of the slider body 2 has left and right pull holding portions 31 which swingably hold one end of the pull 5, an insertion groove 32 which is disposed at the center in the transverse direction of the top surface of the upper wing plate 21, into which the locking pawl 6 is inserted, recesses 33 provided at the front end of the upper wing plate 21 so as to locate the insertion groove 32 in between, a left-right pair of caulking portions 34 which are provided so as to rise up from the bottom surfaces of the recesses 33, protruded portions 35 which are disposed between the pull holding portions 31 and the recesses 33 and on the left and right sides of the insertion groove 32, formed so as to protrude from the top surface of the upper wing plate 21, and a pull disengaging portion 36 which engages with the pull 5 so as to be removable by pulling when the pull 5 is fallen towards the rear hole 27 side.

The pull holding portions 31 have front-rear pairs of pull caulking projections disposed on the left and right sides of the insertion groove 32. A connecting bar 53 of the pull 5, which will be described later, can be swingably held by the pull holding portions 31 by inserting the connecting bar 53 of the pull 5 between the pull caulking projections 31*a*, and then by caulking the front-rear pairs of pull caulking projections 31*a* so as to bend them in the mutually approaching direction.

The insertion groove 32 has a width equivalent to, or slightly larger than the width (dimension in the transverse direction) of the locking pawl 6 so as to allow stable insertion of the locking pawl 6. A pawl hole 37 is formed on the rear end of the insertion groove 32 by piercing so that the pawl hole 37 allows insertion of a later-described pawl portion 61 of the locking pawl 6 when the locking pawl 6 is placed in the insertion groove 32.

The recesses 33 are formed on the top surface of the area, where the connection post 23 is connected (i.e., front end portion), of the upper wing plate 21. In Example 1, since the insertion groove 32 extends along the front-back direction at the center in the transverse direction, the recesses 33 are disposed so as to be divided into left and right sections while placing the insertion groove 32 in between. Step portions 38 are formed in a portion surrounding the front half part of the recesses 33 and each of the step portions has a stepped surface at the level of height between those of the top surface of the upper wing plate 21 and the bottom surface of the recess 33.

The locking pawl 6 is made of a metal such as copper alloy, stainless steel or copper alloy and has elasticity. As seen in FIG. 3 and FIG. 5, the locking pawl 6 has a pawl portion 61 at one end thereof which can be inserted into, or ejected from the element guiding path 28 through the pawl hole 37 of the slider body 2, and has a hook portion 62 at the other end thereof which is inserted into the front end 32*a* of the insertion groove 32 of the slider body 2. The hook portion 62 is formed by bending the other end portion toward the insertion groove 32. The front end 32*a* of the insertion groove 32 inclines downwardly to form a recess, into which the hook portion 62 may be engaged.

A cover portion 63 having a nearly U-shaped cross section is provided between the pawl portion 61 and the hook portion 62 of the locking pawl 6, but more closer to the pawl portion 61 so as to cover the connecting bar 53 and the cam portion 56 of the pull 5 from above. A flat portion 65 extending along the insertion groove 32 are also provided more closer to the hook portion 62.

Figure 4:
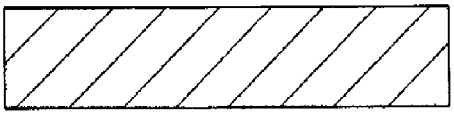
FIG. 4 shows a cross sectional view taken along the dashed line A in FIG. 3 (upper figure), and a cross sectional view taken along the dashed line B (lower figure).
Figure 4:
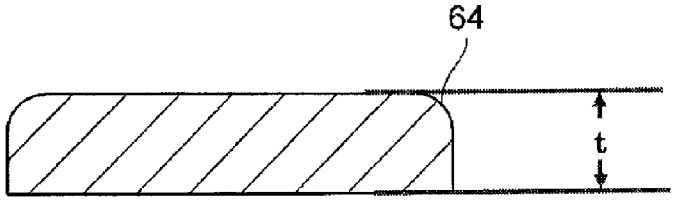

The locking pawl 6 has first rounded chamfer portions 64 which are formed on the left and right ridges of the top surface of the flat portion 65 and each of the first rounded chamfer portions 64 extends forward from midway of the top surface to a bent portion 66 forming a boundary between the flat portion 65 and the hook portion 62. FIG. 4 schematically illustrates a cross section taken at an unchamfered portion indicated by the dashed line A in FIG. 3 (upper figure), and a cross section taken at a chamfered portion indicated by the dashed line B (lower figure). The locking pawl 6 also has second rounded chamfer portions 67 formed on the left and right ridges of the lower surface of the cover portion 63. Accordingly, stress load locally applied to the contact surface of the caulking portions 34 with the locking pawl 6 and the contact surface of the cam portion 56 or the connecting bar 53 with the locking pawl 6 may be reduced. Radius of chamfering of the first and second rounded chamfer portions 64, 67 may optionally be determined by taking size of the slider and an expected effect of reducing the stress into consideration, wherein it is preferably determined within the range from t/2 to t/3 (t represents thickness of sheet, see FIG. 4). The radius is determined within this range, so that the side surfaces of the caulking portions 34 may smoothly slide over the rounded chamfer portions 64, 67 so as to allow smooth caulking.

Figure 6A:
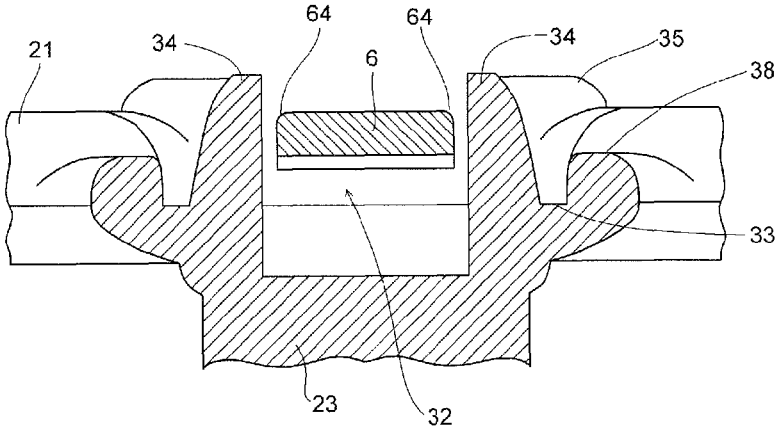
FIG. 6A is a cross sectional view taken along the line IV-IV in FIG. 5, with the caulking portions before caulking and fixing the locking pawl.
Figure 6B:
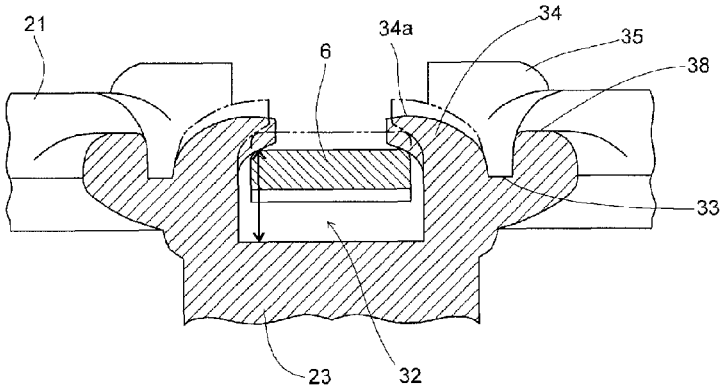
FIG. 6B is a cross sectional view taken along the line IV-IV in FIG. 5.

Referring to FIG. 6A, illustrating a cross sectional view taken along the line IV-IV in FIG. 5 with the caulking portions 34 before caulking and fixing the locking pawl, the caulking portions 34 of the slider 1A of Example 1 are provided so as to rise up from the bottom surfaces of the recesses 33. In this state, as illustrated in FIG. 6B, by inserting the locking pawl 6 into the insertion groove 32 of the upper wing plate 21, and bending the left and right caulking portions 34 inwardly for caulking, the other end of the locking pawl 6 may be fixed by caulking while remaining the presence of a predetermined clearance (see the two-way arrow in FIG. 6B) between the inner surfaces of the end portions of the caulking portions 34 and the bottom surface of the insertion groove 32.

In Example 1, when the locking pawl 6 is fixed by caulking, the level of height of the upper ends 34*a* of the caulking portions 34 is lower than that of the top surface of the upper wing plate 21. Accordingly, the caulking portions 34 are not protruded out from the top surface of the upper wing plate 21 and are thereby prevented from being brought into contact with other components, so that the caulking portions 34 are prevented from being directly subjected to external force and from crushing. As a consequence, it is possible to maintain the size of clearance in a stable manner, which is provided inside the caulking portions 34 when the other end of the locking pawl 6 is fixed.

The level of height of the upper ends 34*a* of the caulking portions 34 is variable depending on the degree of bending of the caulking portions 34, and thereby the level of height of the locking pawl 6 may be adjusted. The two-dot chain line in FIG. 6B illustrates this adjustment. The higher the level of height of the locking pawl 6 is, the more the spring force of the locking pawl 6 decreases. In contrast, the lower the level of height of the locking pawl 6 is, the more the spring force of the locking pawl 6 increases. The level of height of the upper ends 34*a* of the caulking portions 34 may also be adjusted to the same plane with the top surface of the upper wing plate 21.

The ridges to be brought into contact with the caulking portions 34 on the top surface of the flat portion 65 of the locking pawl 6 of Example 1 is provided with the first rounded chamfers 64, so that the locking pawl 6 becomes more smoothly slidable over the contact surface with the caulking portions 34. Accordingly, the locking pawl 6 becomes less likely to be caught by the caulking portions 34, and thereby the locking pawl 6 becomes more readily be arranged to a predetermined position corresponded to the degree of bending of the caulking portions 34. In addition, since the caulking portions 34 are relieved from local stress on the contact surface thereof with the locking pawl 6, so that the contact surface becomes less likely to originate cracks.

In addition, the first rounded chamfer portions 64 extend from the flat portion 65 to the top surface of the bent portion 66. The locking pawl 6 is made of a single flat sheet. Generally, the locking pawl 6 is manufactured by punching the contour of the locking pawl 6 from the sheet, uniformly chamfering the ridges to be brought into contact with the caulking portions 34 to give a rounded profile, followed by bending so as to form the hook portion 62 and the cover portion 63. In this process, by forming the rounded chamfer portion over the portion where the hook portion 62 is subjected to plastic deformation, the rounded chamfer portion may be formed in a stable manner in the process of bending for forming the hook portion 62.

The caulking portions 34 are formed so that when the locking pawl 6 is fixed therein by caulking, the upper ends 34*a* thereof are placed at the level of height higher than that of the stepped surfaces of the step portions 38. With this configuration, when the other end of the locking pawl 6 is fixed by caulking by the caulking portions 34, a predetermined clearance, in which the other end of the locking pawl 6 is movable in the vertical direction, may be ensured in a stable manner, between the inner surfaces of the end portions of the caulking portions 34 and the bottom surface of the insertion groove 32.

The protruded portions 35 are disposed on the left and right sides of the insertion groove 32 so as to protrude from the top surface of the upper wing plate 21. By virtue of the provision of the protruded portions 35, if for example the locking pawl 6 is disposed on the insertion groove 32 and a part of the locking pawl 6 moves above the top surface of the upper wing plate 21 in association with vertical movement of the locking pawl 6 in the insertion groove 32 induced by operation of the pull 5, the locking pawl 6 is hidden from the left and right by the protruded portions 35 so as not to protrude out from the insertion groove 32, ensuring a good aesthetics of the slider 1A.

The protruded portions 35 determine falling limit of the pull 5 by allowing themselves to contact with the pull 5 when the pull 5 is attached to the slider body 2 and falls toward the connection post 23 side as will be described later. With this configuration, even if the pull 5 falls towards the connection post 23 side entirely, a gap is ensured between the fallen pull 5 and the top surface of the upper wing plate 21, and thereby the pull 5 may be prevented from colliding against the caulking portions 34.

The pull disengaging portion 36 is provided on the top surface of the upper wing plate 21 so as to protrude upwardly at the center of the end portion on the rear hole 27 side. The pull disengaging portion 36 has a neck portion 36*a* which stands on the top surface of the upper wing plate 21, and a disengaging head 36*b* which is provided to the upper end of the neck portion 36*a* and swells leftward and rightward out from the neck portion 36*a*. In this configuration, size of the disengaging head 36*b* in the front-back direction is adjusted equally to that of the neck portion 36*a*. The top surface of the disengaging head 36*b* is formed flat, and the left and right edges thereof are formed so as to swell outward to give a arc-like profile.

The pull 5 of Example 1 has a pull body 51, left and right arm portions 52 extending from one end of the pull body 51 in a parallel manner, and a connecting bar 53 connecting end parts of the left and right arm portions 52. The center of the top and back surfaces of the pull body 51 is provided with a rectangular window-like opening 54 so as to extend therethrough from the top to back. The window-like opening 54 is surrounded by sidewalls, and a sidewall 54*a* of those sidewalls, which is disposed on the other end side of the pull 5 has left and right cantilever hooking pieces 55, extends therefrom towards the connecting bar 53.

More specifically, the left and right cantilever hooking pieces 55 have first hooking piece portions 55*a* extending so as to incline the mutual distance from the bases to the ends, and second hooking piece portions 55*b* extending from the ends of the first hooking piece portions 55*a* in parallel to each other. In this configuration, the distance between the left and right second hooking piece portions 55*b* is set larger than the width-wise dimension of the neck portion 36*a* of the pull disengaging portion 36 provided to the slider body 2, and smaller than the width-wise dimension of the disengaging head 36*b* of the pull disengaging portion 36.

Figure 8:
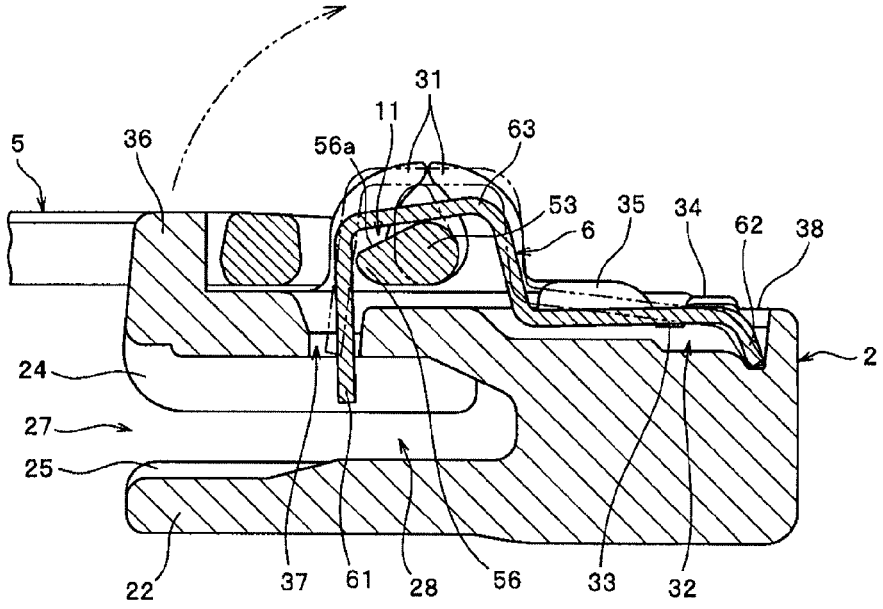
FIG. 8 is a center cross sectional view illustrating the slider of Example 1 of the present invention, which shows an erecting operation of the pull from the state of being fallen towards the rear hole.
Figure 9:
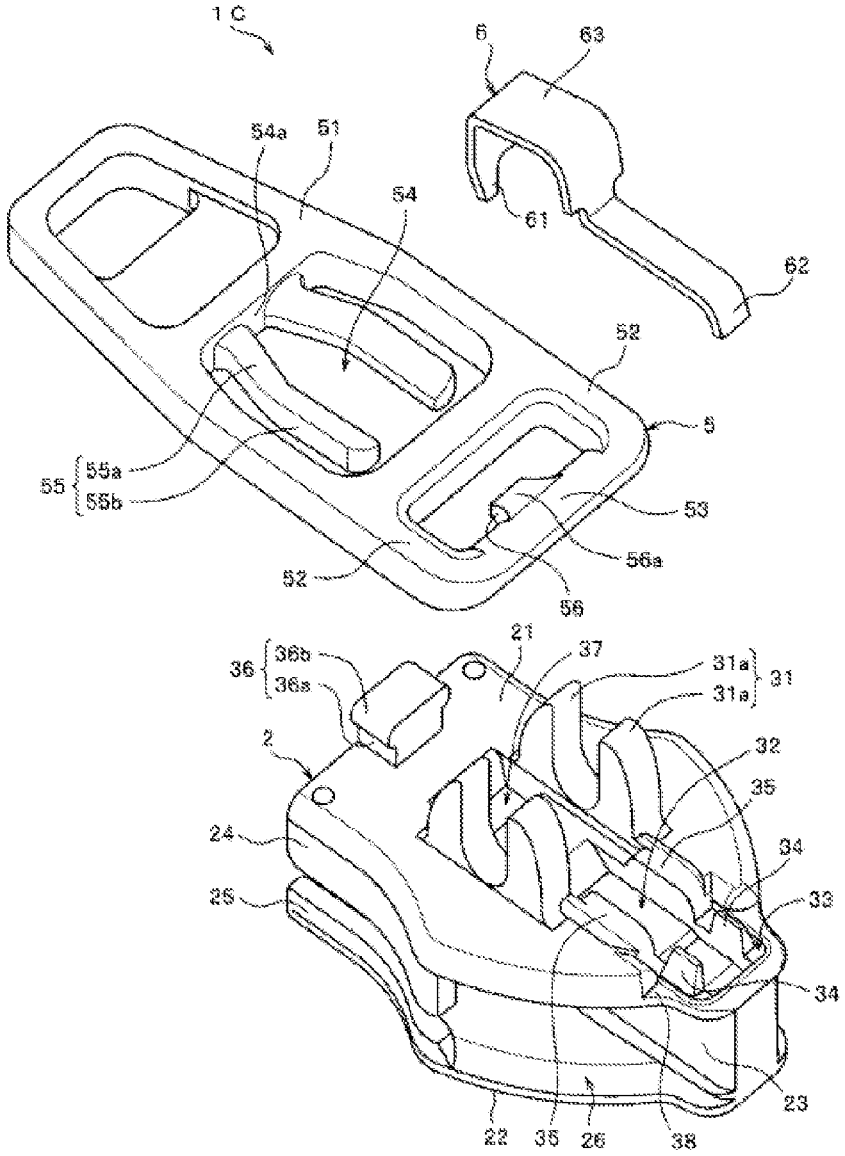
FIG. 9 is a perspective view illustrating of the slider described in Patent Document 1, with the components exploded.
Figure 10:
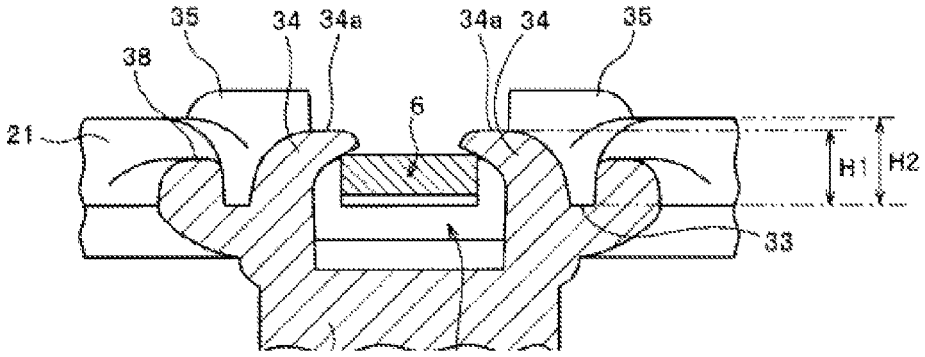
FIG. 10 is a cross sectional view of the slider described in Patent Document 1, illustrating the area where the caulking portion is provided.

The connecting bar 53 of the pull 5 is formed into a cylinder so as to have a circular cross section, and the center of the connecting bar 53 is provided with a cam portion 56 which is integrally formed therewith and protrudes into an opening formed by the connecting bar 53, the left and right arm portions 52 and one edge of the pull body 51. The cam portion 56 has an inclined plane 56*a* on a first surface (top surface) thereof, which inclines downward towards the end of the cam portion 56 so as to gradually reduce the cross section of the cam portion 56, taken along the direction orthogonal to the longitudinal direction of the pull 5, from the base to the end. Accordingly, typically as illustrated in FIG. 8, when the pull 5 is entirely fallen down on the slider body 2 towards the rear hole 27 side, a predetermined gap 11 may successfully be formed between the inclined plane 56*a* of the cam portion 56 and the later-described cover portion 63 of the locking pawl 6.

The cover portion 63 of the locking pawl 6 has a width smaller than the distance between the left and right pull holding portions 31 provided to the slider body 2, and larger than the width of the insertion groove 32 formed in the slider body 2. A portion of the locking pawl 6 on the other end side of the cover portion 63 has a width smaller than the width of the insertion groove 32 formed in the slider body 2.

In the slider 1A of Example 1, typically as illustrated in FIG. 5, by tilting the pull 5 down to the rear hole 27 side of the slider body 2, the cam portion 56 formed on the connecting bar 53 of the pull 5 is directed nearly parallel to the top surface of the upper wing plate 21. Since the cam portion 56 of the pull 5 does not interfere with the cover portion 63 of the locking pawl 6, so that the cover portion 63 of the locking pawl 6 will not be lifted up by the cam portion 56, and the pawl portion 61 of the locking pawl 6 is allowed to protrude through the pawl hole 37 into the element guiding path 28.

Accordingly, in a slide fastener configured by inserting element arrays of the slide fastener chains into the slider 1A of Example 1, by tilting the pull 5 down towards the rear hole 27 of the slider body 2, the pawl portion 61 of the locking pawl 6 protrudes into the element guiding path 28 so as to engage with the element arrays, to thereby maintain a stop position of the slider 1A relative to the element arrays.

Figure 7:
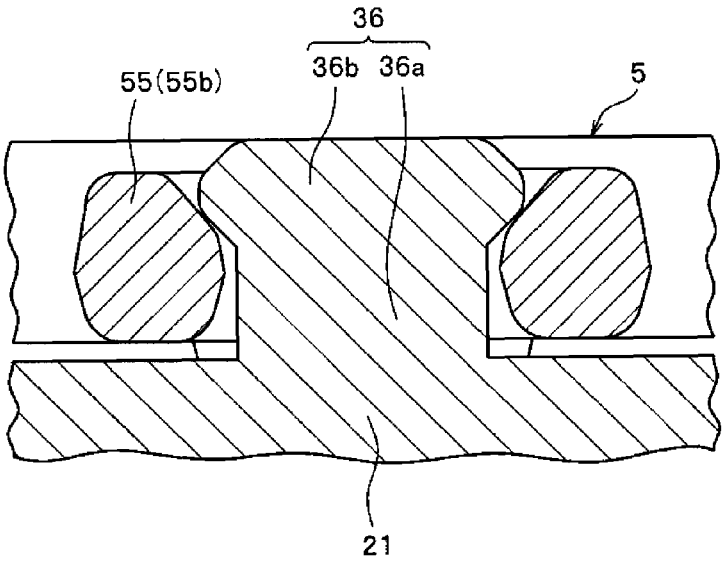
FIG. 7 is a cross sectional view taken along the line V-V in FIG. 5.

In addition, in the case that the pull 5 is tilted down towards the rear hole 27 side of the slider body 2 as described in the above, by pressing the pull 5 into the pull disengaging portion 36 disposed in the slider body 2, the left and right cantilever hooking pieces 55 disposed in the pull 5 are allowed to climb over the disengaging head 36*b* of the pull disengaging portion 36 while being warped outwardly, and may be engaged with the pull disengaging portion 36 of the slider body 2, typically as illustrated in FIG. 2, FIG. 5 and FIG. 7.

By engaging the cantilever hooking pieces 55 of the pull 5 with the pull disengaging portion 36 of the slider body 2 as described in the above, it is possible to keep the pull 5 in falling condition. Accordingly, the pawl portion 61 of the locking pawl 6 is stably kept as being protruded into the element guiding path 28 and being engaged with the element arrays, and thereby the slider may be maintained consistently at the stop position. The state of engagement of the cantilever hooking pieces 55 of the pull 5 with the pull disengaging portion 36 of the slider body 2 may be removed simply by tilting the pull 5 away from the upper wing plate 21.

In the slider 1A of Example 1, as illustrated in FIG. 5, the cam portion 56 of the pull 5 has a downwardly inclined plane 56*a*. Accordingly, even if for example the pull 5 located on the pull disengaging portion 36 is inclined relative to the top surface of the upper wing plate 21, with the cantilever hooking pieces 55 thereof unengaged with the pull disengaging portion 36 of the slider body 2, the cam portion 56 of the pull 5 will not interfere with the cover portion 63 of the locking pawl 6, so that the pawl portion 61 of the locking pawl 6 may be protruded into the element guiding path 28 and may be engaged with the element arrays.

With this configuration, even if the pull 5 is lifted up a little in order to remove the engagement of the pull 5 with the pull disengaging portion 36, the engagement of the pull 5 may be removed while keeping the slider 1A at the stop position, without allowing the pawl portion 61 of the locking pawl 6 to be drawn out from the element guiding path 28, only by tilting the pull 5 within a range not causative of interference between the cam portion 56 of the pull 5 and the cover portion 63 of the locking pawl 6.

On the other hand, in the slider 1A of Example 1, when the pull 5, being tilted down on the rear hole 27 side of the slider body 2, is tilted up to the direction normal to the upper wing plate 21 as indicated by the two-dot chain line in FIG. 8, the cam portion 56 of the pull 5 interferes with the cover portion 63 of the locking pawl 6, as the pull 5 inclines by a predetermined angle away from the top surface of the upper wing plate 21, thereby the locking pawl 6 is lifted up by the cam portion 56, and the pawl portion 61 of the locking pawl 6 may be drawn out from the element guiding path 28.

Since the other end of the locking pawl 6 in this event is fixed by caulking by the caulking portions 34 while keeping a predetermined clearance, so that the locking pawl 6 may readily be warped within the insertion groove 32 by virtue of the clearance and the pawl portion 61 may be drawn out smoothly.

Moreover, in the slider 1A in Example 1, by tilting the pull 5 down towards the connection post 23 side from its tilted-up state, the cam portion 56 of the pull 5 no longer interferes with the cover portion 63 of the locking pawl 6, so that the cover portion 63 of the locking pawl 6 descends, and thereby the pawl portion 61 protrudes into the element guiding path 28 and engages with the element arrays. In this way, the slider 1A may be maintained at the stop position.

In the series of the tilting operation of the pull 5 described in the above, the connecting bar 53 or the cam portion 56 will be brought into sliding contact with the ridge of the back surface of the cover portion 63 of the locking pawl 6, wherein any flash possibly resides on the ridge may prevent smooth sliding between the pull 5 and the locking pawl 6, and may even make the contact portion of the connecting bar 53 or the cam portion 56 with the cover portion 63 more scratchable. In contrast, in the slider 1A in Example 1, since the second rounded chamfer portions 67 are formed on the left and right ridges of the back surface of the cover portion 63, so that the pull 5 may be tilted down and up smoothly, while allowing contact of the connecting bar 53 and the cam portion 56 with the locking pawl 6.

Next, a method of assembling the slider 1A of Example 1 is explained. First, the connecting bar 53 of the pull 5 is inserted between the front and rear pull caulking projections 31 which is individually included in the left and right pull holding portions 31 of the slider body 2, and the front and rear pull caulking projections 31*a* are bent in the mutually approaching direction for caulking, while keeping the pull 5 tilted down towards the rear hole 27 side of the slider body 2. In this way, the pull 5 is held to the slider body 2 so as to be swingable around the connecting bar 53.

Next, the locking pawl 6 is inserted into the insertion groove 32 of the slider body 2 having the pull 5 held thereon, so that the pawl portion 61 of the locking pawl 6 is inserted into the pawl hole 37 of the slider body 2, and, so that the cover portion 63 of the locking pawl 6 covers the connecting bar 53 and the cam portion 56 of the pull 5 from the top. In this way, the locking pawl 6 is disposed at a predetermined position of the slider body 2.

Thereafter, by bending the caulking portions 34 provided to the slider body 2 inwardly for caulking, the other end of the locking pawl 6 is caulked and fixed by the caulking portions 34, while keeping a predetermined clearance, with the pawl portion 61 of the locking pawl 6 kept inserted into the pawl hole 37. By the process, the slider 1A of Example 1, illustrated in FIG. 2, may be assembled.

Having described the present invention referring to Examples, the present invention is not limited to these Examples, and may be modified in various ways. For example, the pull disengaging portion 36 which engages the pull 5, tilted down towards the rear hole 27 side, so as to be removable by pulling, is omissible. In this case, it is no more necessary for the pull body 51 to have the left and right cantilever hooking pieces 55.

In the slider of Example 1, while the pull 5 is caulked and fixed by the pull holding portions 31 provided so as to protrude from the upper wing plate 21 of the slider body 2, the pull 5 may alternatively be attached to the slider body 2 using a cover (not illustrated) engageable with the slider body 2, presupposing that the locking pawl 6 is fixed by caulking to the slider body 2.

DESCRIPTION OF SYMBOLS

1A, 1C slider
2 slider body
5 pull
6 locking pawl
11 gap
21 upper wing plate
22 lower wing plate
23 connection post
24 upper flange
25 lower flange
26 shoulder hole
27 rear hole
28 element guiding path
31 pull holding portion
31*a* pull caulking projection
32 insertion groove
32*a* front end of insertion groove
33 recess
34 caulking portion
34*a* upper end
35 protruded portion
36 pull disengaging portion
36*a* neck portion
36*b* disengaging head
37 pawl hole
38 step portion
51 pull body
52 arm portion
53 connecting bar
54 window-like opening
54*a* sidewall

55 cantilever hooking piece
55*a* first hooking piece portion
55*b* second hooking piece portion
56 cam portion
56*a* inclined plane
61 pawl portion
62 hook portion
63 cover portion
64 first rounded chamfer portion
65 flat portion
66 bent portion
67 second rounded chamfer portion

The invention claimed is:

1. A slider for slide fastener comprising:

a slider body in which upper and lower wing plates are connected to each other at front ends thereof by a connection post, and a Y-shaped element guiding path is disposed between the upper and lower wing plates;

a pull swingably held at one end thereof by the upper wing plate; and a locking pawl disposed in the upper wing plate and having a pawl portion on one end thereof, the upper wing plate comprising an insertion groove into which the locking pawl is inserted; caulking portions caulking and fixing a second end of the locking pawl; and a pawl hole pierced so as to allow therethrough insertion of the pawl portion, the locking pawl being arranged so as to allow the pawl portion to be inserted to, or ejected from the element guiding path through the pawl hole by falling or erecting operations of the pull, wherein at least edges of the locking pawl, which are in contact with the caulking portions, are each provided with a chamfer portion, wherein the locking pawl has a hook portion on the second end of the locking pawl, and the hook portion is engaged in a front end of the insertion groove, the locking pawl has a flat portion provided between the pawl portion and the hook portion, the edges of the locking pawl which are in contact with the caulking portions are located between a portion of a top surface of the flat portion and each side surface of the flat portion, the chamfer portions extend along a bent portion of the locking pawl located between the hook portion and the flat portion, and each chamfer portion contacts an inner surface of one of the caulking portions so that the inner surface of each of the caulking portions faces the top surface and one of the side surfaces of the locking pawl and an end of each of the caulking portions extends inwardly over the locking pawl in a transverse direction of the slider.

2. The slider for slide fastener according to claim 1, wherein the chamfer portions have a rounded profile so as to be slidable over a contact surface with the caulking portions.

3. The slider for slide fastener according to claim 2, wherein a radius of chamfering of the chamfer portions are within the range from t/2 to t/3, where t is a thickness of the locking pawl at the chamfer portions.

4. The slider for slide fastener according to claim 1, wherein the pull has a pull body, left and right arm portions extending from one end of the pull body in a parallel manner, and a connecting bar connecting end parts of the left and right arm portions, a cam portion is integrally provided at a center portion of the connecting bar and protrudes into an opening formed by the connecting bar, the left and right arm portions, and one edge of the pull body, a cover portion having a nearly U-shaped cross section is provided between the pawl portion and the flat portion of the locking pawl and is disposed so as to cover the connecting bar and the cam portion from above, and edges of the cover portion, configured to contact the cam portion or the connecting bar, have a rounded chamfer portion.

* * * * *